US005224336A

United States Patent [19]

Agrawal et al.

[11] Patent Number: 5,224,336

[45] Date of Patent: Jul. 6, 1993

[54] PROCESS AND SYSTEM FOR CONTROLLING A CRYOGENIC AIR SEPARATION UNIT DURING RAPID CHANGES IN PRODUCTION

[75] Inventors: Rakesh Agrawal, Allentown, Pa.; David M. Espie, Ealing; Declan P. O'Connor, Surrey, both of England; Jorge A. Mandler, Allentown, Pa.; Arthur R. Smith, Talford, Pa.; Donald W. Woodward, New Tripoli, Pa.

[73] Assignee: Air Products and Chemicals, Inc., Allentown, Pa.

[21] Appl. No.: 718,504

[22] Filed: Jun. 20, 1991

[51] Int. Cl.[5] ..... F25J 3/00

[52] U.S. Cl. ..... 62/37; 62/24; 62/29; 62/30; 62/31; 62/40

[58] Field of Search ..... 62/24, 29, 30, 31, 33, 62/37, 40

[56] References Cited

U.S. PATENT DOCUMENTS

| | | | |
|---|---|---|---|
| 3,208,230 | 9/1965 | Fourroux | 62/37 X |
| 3,731,495 | 5/1973 | Coveney | 62/39 |
| 3,912,476 | 10/1975 | Mikawa et al. | 62/37 |
| 4,224,045 | 9/1980 | Olszewski et al. | 62/30 |
| 4,251,248 | 2/1981 | Iyoki et al. | 62/37 X |
| 4,529,425 | 7/1985 | McNeil | 62/37 |
| 4,617,040 | 10/1986 | Yoshino | 62/37 |
| 4,732,595 | 3/1988 | Yoshino | 62/37 X |
| 5,084,081 | 1/1992 | Rohde | 62/37 X |

*Primary Examiner*—Henry A. Bennet
*Assistant Examiner*—Christopher Kilner
*Attorney, Agent, or Firm*—Willard Jones, II; William F. Marsh; James C. Simmons

[57] ABSTRACT

A process and system for controlling a cryogenic air separation unit during rapid changes in production. During operation of an air separation unit, demands for oxygen will vary and the pressure of the feed air will fluctuate. The changes in oxygen demand and feed air pressure translate into a ramping, either up or down, of the distillation system pressure in the air separation unit. Because the product streams have tight purity requirements, the ramping system pressure (which could adversely affect product purity) is compensated for. This compensation is by way of a net transfer of refrigeration, in the form of liquid nitrogen, into and out of the distillation system. This transfer of refrigeration is implemented using a storage vessel of liquid nitrogen connected to the reflux path of the distillation system. Liquid nitrogen via the reflux path is removed and stored or added to the distillation system to decrease or increase the refrigeration, respectively.

22 Claims, 3 Drawing Sheets

LIN HOLDUP TANK
LI
FIC
LP COLUMN
HP COLUMN
LPGAN RECYCLE
CRUDE LIQUID OXYGEN
PIC
LPGAN
GOX
HPGAN
TO IGCC
AIR
60
124
44
54
116
56
52
114
82
62
50
41
40
42
38
36
34
30
24
46
48
32
26
22
74
78
70
76
80
72
20

PROCESS AND SYSTEM FOR CONTROLLING A CRYOGENIC AIR SEPARATION UNIT DURING RAPID CHANGES IN PRODUCTION

TECHNICAL FIELD

The present invention is related to a cryogenic air separation unit in which the demand for oxygen varies and the pressure of compressed feed air fluctuates.

BACKGROUND OF THE INVENTION

Numerous processes are known for the production of atmospheric gases in particular, oxygen, by means of a cryogenic air separation unit (ASU) for which the feed air compressor is mechanically linked to a combustion gas turbine. Among these are U.S. Pat. Nos. 4,224,045 and 3,731,495.

The escalating costs of energy have intensified research in the field of alternate energy sources. One result of this quest is the recently developed Integrated Gasifier Combined Cycle (IGCC) power plant. Using a mixture of coal and oxygen (where, typically, the purity of the oxygen will be higher than 80 vol % oxygen), the IGCC produces energy—electricity.

Because the operation of such a plant depends on consumer demand for electricity, the input of the plant, specifically oxygen, needs to vary along with the electricity demand. Unfortunately, a problem is created by integrating the ASU (for producing oxygen) with the IGCC having a combustion gas turbine as is taught in U.S. Pat. No. 4,224,045.

In an IGCC that is mechanically linked to an (integrated) ASU, the feed air for the ASU is compressed by a gas turbine. The operation and output of the gas turbine depend on the exhaust gas from combustion of the gasifier product and, in part, from the low pressure gaseous nitrogen product of the ASU. The problem arises because the normal mode of operation for an IGCC is not static. As mentioned, an IGCC is usually required to ramp in response to varying demands for electrical power. By ramping the operation of the gasifier, an operational effect is seen in the combustion gas turbine which in turn will mean variations in the pressure of the compressed feed air to the ASU. The ramping of the IGCC means either an increased or decreased need for products from the ASU, in particular, the quantities of oxygen needed for the gasifier operation. Also, it is important that during increased or decreased production by the air separation unit, the purity of the products remain constant.

However, before the advent of the IGCC, ASU's did not have to vary their production as severely as the operation of an IGCC requires, and they were designed accordingly. To illustrate the problem, during a ramp down of the ASU less product is needed, yet liquids in the distillation columns are flashing as the air supply pressure decreases tending to generate more product (this is contrary to the customer's requirements). Also, the flashing liquid is oxygen rich which could potentially degrade the nitrogen product purity. Thus, the problem: how to control the ramping of an air separation unit which has a varying compressed feed air pressure, varying demands for oxygen and strict purity requirements.

SUMMARY OF THE INVENTION

A process and system for separating air using a cryogenic distillation system having at least one distillation column where air is separated into oxygen-rich and nitrogen-rich products. The process substantially maintains product purity requirements during either an increase in product demand and feed air pressure or a decrease in product demand and feed air pressure. There is provided a reflux flow of nitrogen-rich fluid in the distillation system. A portion of the nitrogen-rich reflux flow fluid is removed and stored as the product demand and feed air pressure increase. A portion of the stored nitrogen-rich fluid is added to the reflux flow as the product demand and feed air pressure decrease.

DETAILED DESCRIPTION OF THE INVENTION

Overview

Figure 1:
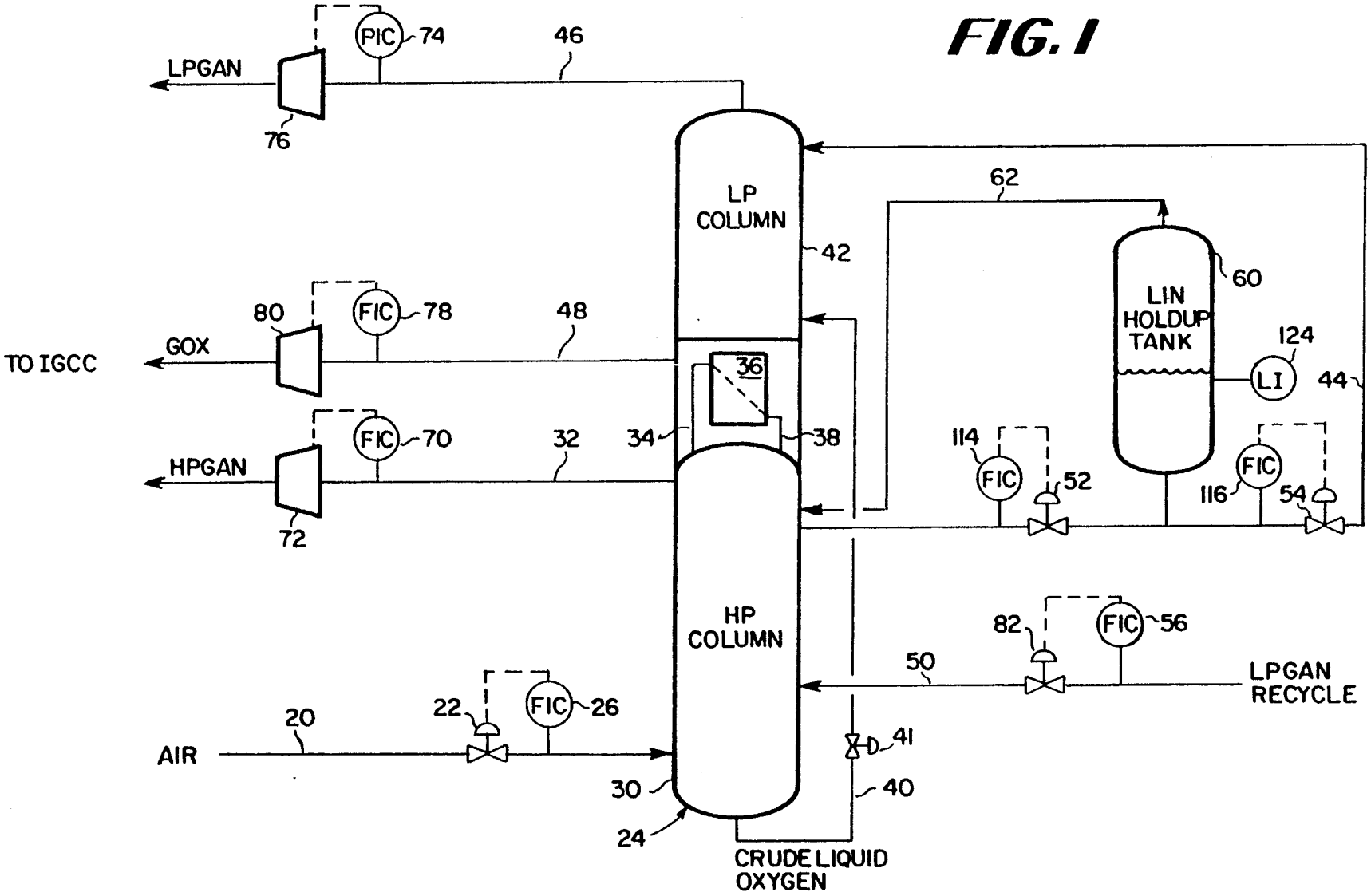
FIG. 1 is a schematic diagram of the process of the present invention.

To understand the present invention, it is important to first understand an air separation unit (ASU) 10 which is to be controlled. With reference to FIG. 1, impurities-free, compressed feed air is fed, via line 20, through control valve 22 to the bottom of the high pressure distillation column 30 of double column distillation system 24.

In high pressure distillation column (HP column) 30, the cooled, impurities-free, compressed feed air from line 20 is fractionated into a high pressure, nitrogen vapor overhead and an oxygen-enriched bottoms liquid. A portion of the high pressure, nitrogen vapor overhead is fed, via line 34, to reboiler/condenser 36 located in the bottom of low pressure distillation column (LP column) 42, where it is condensed by indirect heat exchange with boiling liquid oxygen. The condensed liquid nitrogen is returned from reboiler/condenser 36, via line 38, as pure reflux for HP column 30. The remaining high pressure nitrogen overhead is removed, via line 32, from HP column 30, as a high pressure gaseous nitrogen product regulated by flow controller 70 and compressor 72. The oxygen-enriched bottoms liquid is removed from HP column 30, via line 40 and valve 41, and fed to an intermediate location of LP column 42.

Reflux for LP column 42 is provided by removing liquid nitrogen from an upper-intermediate location of HP column 30, via line 44, and feeding this impure nitrogen reflux to the top of LP column 42. The liquid nitrogen reflux, in line 44, and the reduced-pressure oxygen-enriched bottoms liquid, in line 40, are distilled to produce a low pressure gaseous nitrogen product as an overhead and a liquid oxygen product. Heat duty for the boil-up of LP column 42 is provided by the condensing high pressure nitrogen overhead in reboiler/condenser 36.

The low pressure nitrogen overhead is removed from LP column 42, via line 46, as a low pressure nitrogen product regulated by pressure controller 74 and compressor 76. A portion of the low pressure nitrogen product can be recycled, via line 50, to an intermediate location of HP column 30, and the remainder of the nitrogen product is fed to a combustion gas turbine (not shown) of an IGCC. Regulated by flow controller 78 and compressor 80, a gaseous oxygen product is removed from LP column 42, via line 48, at a location slightly above the outlet of reboiler/condenser 36.

Because ASU 10 is fully integrated into the IGCC, the pressure of the ASU's feed air, line 20, can vary up to about 50% of the normal operating pressure (possibly up to 110 psi) as the flow rate of air is ramped up or down based on the combustion gas turbine. Demands typically placed on a fully integrated ASU are such that it must be capable of operating in the range of 50% to 100% of design capacity while responding to rampings at about 3% of capacity per minute. For example, given a 2000 metric tons-per-day ASU, the unit must be capable of ramping at a rate of 0.04 metric tons per minute. In addition, for most gasifier applications, the product qualities need to be in the following ranges while ramping:

| | |
|---|---|
| Gaseous Oxygen (GOX) | 95% oxygen ± 1% |
| Gaseous Nitrogen (HPGAN) | <0.1% oxygen |
| Waste Nitrogen (LPGAN) | <1% oxygen |

However, because ASU's are typically designed to produce atmospheric gases (oxygen, line 48, and nitrogen, lines 32 and 46) at steady state, whereas, an IGCC has dynamic ramping demands for the gases, the two systems are inherently incompatible. A solution is an ASU that can efficiently respond to ramping demands. A general description follows of how an ASU 10 incorporating the present invention operates for the ramp down and ramp up cases.

Ramp Down

Figure 3:
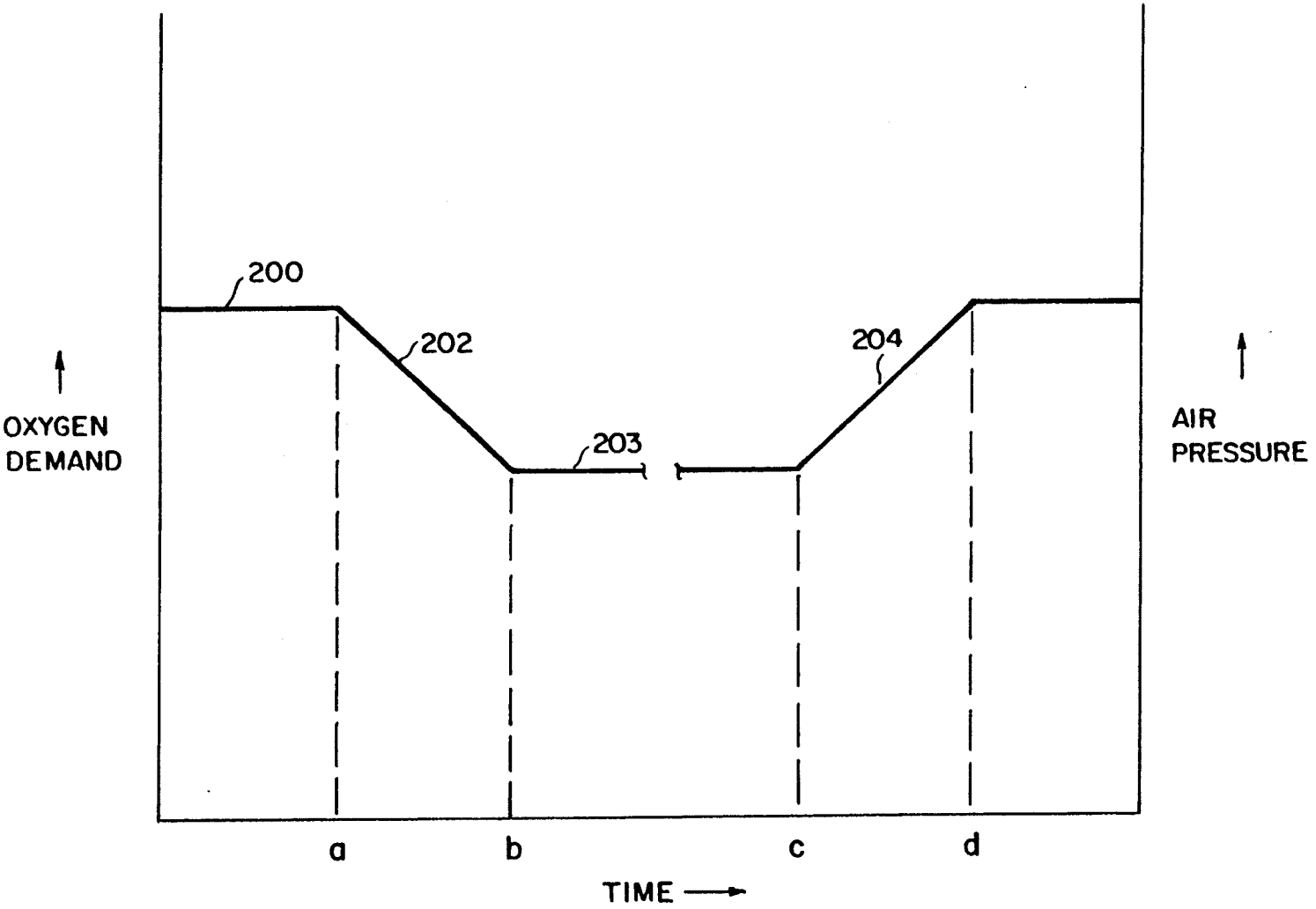
FIG. 3 is a plot representing the ramp down and ramp up conditions for oxygen demand and feed air pressure with respect to time of the process of FIG. 1.

A decrease in demand for gaseous oxygen product, line 48, translates into a proportionate decrease in compressed feed air flow, line 20. Since air is approximately four parts nitrogen and one part oxygen, the air flow, line 20, will be approximately five times the desired gaseous oxygen product flow, line 48. Initially in steady state operation as shown by FIG. 3, Section 200, as the compressed feed air flow, line 20, is decreased with a corresponding reduction in feed air pressure, the pressure in the distillation system 24 decreases, represented by graph section 202, causing liquids to flash. The increase in gases is contrary to the desired result and potentially harmful to nitrogen product purity. To compensate, adequate column liquid inventory in distillation system 24 needs to be maintained. Thus, refrigeration, in the form of liquid nitrogen, is introduced into distillation system 24 from a hold-up tank 60 via the reflux path, line 44. The additional liquid nitrogen condenses oxygen vapors, driving them to the bottom of the LP column 42 and preserving nitrogen purity.

Ramp Up

Once the ramp down has settled to steady state operation as shown in FIG. 3 section 203, an increase in the demand for gaseous oxygen product, line 48, translates into a proportionate increase in compressed feed air flow, line 20. To accommodate an increase in demand for gaseous oxygen product, line 48, the compressed feed air flow, line 20, needs to increase, which consequently increases the pressure in the distillation system 24, as represented by graph section 204. As pressure increases, vapor tends to condense to liquid. To compensate for the increased pressure and condensing vapors, adequate column liquid inventory in distillation system 24 needs to be maintained. Thus, refrigeration, in the form of liquid nitrogen, is removed, via line 44, from distillation system 24 and stored in hold-up tank 60, consequently preventing loss of product purity. It is important to note that removing liquid nitrogen will not significantly affect temperatures in distillation system 24. Temperature is primarily affected by operating pressure.

Detailed Description

General Control

As the gas turbine (not shown) loads up and down, the compressed feed air pressure, line 20, to the ASU 10 varies accordingly. To enable the ASU 10 to operate efficiently, the distillation system 24 pressure follows the compressed feed air pressure. To effect this change, the low pressure nitrogen flow, line 46, from the LP column 42 is adjusted to raise/lower the distillation system 24 pressure.

The liquid and vapor in distillation system 24 are at bubble and dew point conditions, so the temperature varies directly with the pressure. To maintain an adequate liquid inventory within the column, refrigeration is moved into and out of distillation system 24 which is implemented using a liquid nitrogen hold-up tank 60. The hold-up tank 60 is connected to the impure nitrogen reflux path, line 44, with one valve 52 upstream and another valve 54 downstream in the reflux path. Also, liquid nitrogen hold-up tank 60 is maintained at high pressure by providing a gas flow, line 62, from the top of hold-up tank 60 to the top of HP column 30.

As plant pressures fall (i.e. as the gaseous oxygen product demand decreases) liquid in distillation system 24 begins vaporizing to gas and the temperature in distillation system 24 begins to drop. To compensate, there is a net transfer of liquid nitrogen from hold-up tank 60 into distillation system 24, by increasing the flow into LP column 42, via valve 54. During this time, excess low pressure nitrogen product, line 46, is removed from LP column 42 to reduce the column pressure, so additional reflux keeps the low pressure nitrogen product purity, line 46, in specification.

Conversely, as distillation system 24 pressures rise (i.e. as the gaseous oxygen product demand increases) gas in distillation system 24 begins condensing to liquid and the temperature in distillation system 24 begins to rise. To compensate, there is a net transfer of liquid nitrogen from distillation system 24 into hold-up tank 60, by reducing the flow into LP column 42, via line 54. During this time, less low pressure nitrogen product, line 46, is removed from LP column 42 to increase pressure, so the reduction in reflux helps to keep the gaseous oxygen product purity, line 48, in specification.

Detailed Control

A more detailed view of the control system reveals the unique approach of determining flow rates using a feed forward strategy based on the gaseous oxygen product flow, line 48, and in addition applying a feedback strategy based on purity measurements. The feed forward aspect of the control system, applicable to both ramp up and ramp down, operates as follows:

a) The desired flow rate of gaseous oxygen product, line 48, is determined by IGCC demand.

b) The gaseous oxygen demand, line 48, is used to calculate, by mass balance, the required flow of feed air, line 20, to high pressure column 30.

c) The pressure control for LP column 42 is directly related to the change in the feed air, line 20, pressure:

$$\Delta P_{LP} = K_{LP}\Delta \cdot P_{Feed\ air} \quad \text{(Eq. 1)}$$

d) The purity control for the low pressure nitrogen product, line 46, is controlled by the impure nitrogen reflux flow, line 44. First, flow of impure nitrogen reflux, line 44, from HP column 30, $F_{impure\ reflux}$, is directly related to the measured flow of feed air, line 20, $F_{measure\ air}$. Hence, $$F_{impure\ reflux} = K_{impure\ reflux} \cdot F_{measure\ air} \quad \text{(Eq. 2).}$$

Second, the flow control for the impure nitrogen reflux, line 44, into the LP column is based on constant ratio between impure nitrogen reflux flow, line 44, and low pressure nitrogen product flow, line 46. However, this ratio is corrected during ramping conditions. The relationship is:

$$\text{Ratio} = \text{Ratio}_{ss} + \Delta\text{Ratio}_{IN2} + \Delta\text{Ratio Level} \quad \text{(Eq. 3)}$$

Where $\Delta$ Ratio$_{IN2}$ represents a correction due to a change in low pressure nitrogen product recycle, line 50. And the $\Delta$ $R_{Level}$ correction is the output from the liquid nitrogen hold-up tank level controller 124.

In an alternate embodiment, the flow of impure nitrogen reflux, line 44, into LP column 42 is controlled by composition analysis. A measurement is taken of the mid-point purity in LP column 42. This measurement detects movements of vapor which, when in excess of a predetermined value, triggers the flow of additional liquid nitrogen from the hold-up tank 60 to compensate for the decrease in pressure. This alternate embodiment preferably requires an oxygen analyzer with adequate response time and reliability.

e) Liquid nitrogen hold-up tank 60 level is directly related to the change in the gaseous oxygen product flow, line 48:

$$\Delta\text{Level} = K_{Level} \cdot \Delta F_{O2} \quad \text{(Eq. 4)}$$

f) The desired flow rate of pure nitrogen product, line 32, is determined by IGCC demand.

g) The flow of the low pressure nitrogen product recycle, line 50, is regulated to maintain the flow of low pressure nitrogen product, line 46:

$$F_{ReN2} = K_{ReN2} + F_{Exp} + F_{N2} + K_{ReN2/AIR}(F_{SPAIR} - F_{AIR}) \quad \text{(Eq. 5)}$$

where $K_{ReN2}$ is a linear loading function:

$$\Delta K_{ReN2} = K_{ReN2/02}\Delta F_{O2}$$

This is regulated by flow controller 56 and valve 82.

h) The lead-lag element describing the skew between air flow, line 20, and gaseous oxygen product flow, line 48, follows:

$$\Delta F_{AIR}^{LAG} = K_{AIR}\Delta F_{O2} - K_{AIR}^{LAG}(F_{AIR}^{LAG} - F_{AIR}) \quad \text{(Eq. 6)}$$

where $\Delta F_{AIR} = K_{AIR} \cdot \Delta F_{O2}$.

i) The control of the LP column sump level is dependent on the refrigeration balance in distillation system 24 and can be based on either the expander flow or the liquid oxygen make. The preferred embodiment implements this control by way of expander flow.

The feedback aspect of the control system operates using a purity measurement for a particular gas or liquid—including low pressure nitrogen product, line 46, gaseous oxygen product, line 48, and the impure nitrogen reflux, line 44,—to update flow rates so to help maintain the purity of the respective gas or liquid. In particular, purity measurement 152 of the gaseous oxygen product, line 48, is used to update flow controller 26 for the feed air flow, line 20. Also, a purity measurement 150 of the low pressure gaseous nitrogen product, line 46, is used to update flow controller 56 for the flow of low pressure gaseous nitrogen product recycle, line 50. Finally, a purity measurement 112 of the impure nitrogen reflux, line 44, is used to update flow controller 114 for the flow of impure nitrogen reflux.

Figure 2:
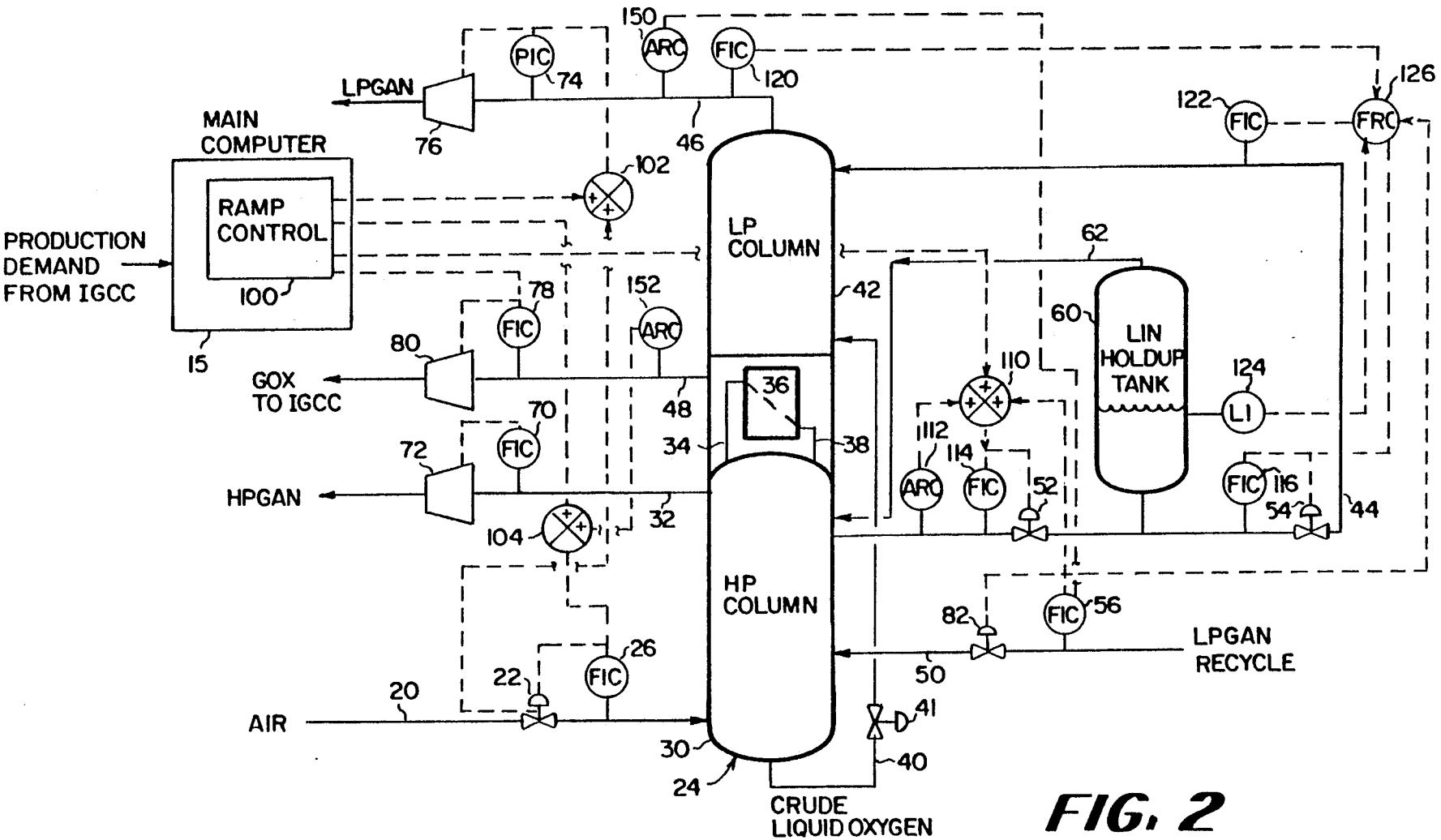
FIG. 2 is a schematic diagram of the process of FIG. 1 in which the control system is shown in more detail.

The details of this control system have been implemented using devices well known to those skilled in the art. The devices as represented in FIG. 2 include pressure controllers (PIC) 74 for pressure control, flow controllers (FIC) 26, 56, 70, 78, 114, 116, 120, and 122; for flow control, analysis controllers (ARC) 112, 150 and 152 for purity control, servo-controlled valves 22, 52, 54, 82, servo-controlled compressors 72, 76, 80 and a main computer 15 for linking the necessary elements together and performing the necessary control system calculations for the ramping.

To better understand the detailed control system and its inter-relationships, the following description of the operational modes of ASU 10 configured for ramp control, particularly the ramping modes, will be discussed with reference to the appropriate controls.

There are three basic modes of operation for a fully integrated ASU. These are: (a) Steady State, when ASU 10 is operated to achieve product flows and purities at maximum efficiency; (b) Ramp Down, when ASU 10 is operated to achieve product flows and purities during a falling demand and falling air pressure; and (c) Ramp Up, when ASU 10 is operated to achieve product flows and purities during a rising demand and rising air pressure.

Steady State

Referring to FIG. 2, the method of control for steady state operation typically comprises the following. The compressed feed air flow, line 20, to HP column 30 is controlled with valve 22, based on the gaseous oxygen product demand, line 48. Additionally, the control is adjusted to maintain correct gaseous oxygen product purity, line 48. LP column 42 pressure is effectively regulated by controlling the flow of the low pressure nitrogen product, line 46, at the highest possible value consistent with the pressure drop across valve 22 needed for controllability. The concentration of oxygen in the low pressure nitrogen product, line 46, is controlled by the flow of impure nitrogen reflux, line 44, combined with the flow of low pressure nitrogen recycle, line 50.

Ramp Down

In general, ramp down in ASU 10 entails a decrease in the feed air pressure, line 20, resulting in a potential loss of control of the air flow unless the HP column 30 and LP column 42 pressures decrease at a similar rate. It is important that the pressure in the LP column 42 be properly set for a given feed air flow, line 20, to maintain the boil-up in the LP column 42 so to meet the gaseous oxygen product demand, line 48.

To decrease the LP column 42 pressure, the low pressure nitrogen product flow, line 46, during the ramp down, is increased more than that proportional to the air flow. However, this adjustment alone would result in the liquid oxygen inventory flashing and the resultant vapors degrading the low pressure nitrogen product purity, line 46. Hence, another critical concern is the possible degradation of the low pressure nitrogen product purity by migrating oxygen vapors. So, in conjunction with the increase in low pressure nitrogen product flow, line 46, to decrease the distillation system 24 pressure, the liquid nitrogen reflux, line 44, is increased to meet the increased refrigeration need of the distillation system, condense the oxygen vapors and maintain the low pressure nitrogen product purity, line 46.

With particular reference to the equations, the desired flow rate of gaseous oxygen product, line 48, is determined by IGCC demand, in this case a decrease. This decreased demand is used by ramp control 100 to calculate the feed forward setpoint of feed air, line 20. This setpoint is added, via setpoint adder 104, to the feedback purity measurement 152 of gaseous oxygen product, line 48, to calculate the flow setpoint for flow controller 26. Related to the feed air flow is the calculation of the LP column 42 pressure control. The change in the LP column 42 pressure is directly related to the change in the feed air pressure (see Eq. 1). Because the feed air flow, line 20, is decreased, the pressure in the LP column 42 will decrease. The feed forward setpoint which is calculated using Eq. 1 by ramp control 100 is added via setpoint adder 102 to the output of a controller which monitors feed air valve 22 position to minimize the pressure drop across feed air valve 22 and prevent its saturation. The output of adder 102 adjusts the pressure setpoint for pressure controller 74.

Having determined both the feed air flow, line 20, and the LP column pressure 42 control, the next parameter to be maintained is the purity of the low pressure nitrogen product, line 46. This is controlled by the impure nitrogen reflux flow, line 44. First, flow of impure nitrogen reflux from the HP column 30 is directly related to the measured flow of feed air (see Eq. 2). Because the feed air flow, line 20, is decreasing the flow of impure nitrogen reflux, line 44, from the HP column 30 will decrease. The feed forward setpoint calculated using Eq. 2 by ramp control 100 is added via setpoint adder 110 to nitrogen waste recycle flow measurement 56 and impure nitrogen reflux purity measurement 112 to calculate the new impure nitrogen reflux flow from HP column 30 regulated by valve 52.

Second, the flow of the impure nitrogen reflux into the LP column 42 is calculated using the ratio of impure nitrogen reflux, line 44, to low pressure nitrogen product, line 46, plus corrections (see Eq. 3). Because the flow of low pressure nitrogen product, line 46, has increased proportional to the feed air flow, line 20, for pressure control to maintain a constant ratio between impure nitrogen reflux, line 44, and low pressure nitrogen product, line 46, the impure nitrogen reflux, line 44, will increase. Also, because the demand for gaseous oxygen product, line 48, is decreasing the level in hold-up tank 60 will decrease (see Eq. 4), this level measurement 124 is used as a correction for Eq. 3. These calculations are used to determine the new setpoint for valve 54 for controlling the impure nitrogen reflux flow, line 44, to the LP column 42. The reflux is particularly critical in controlling the liquid to vapor (L/V) ratio in the top section of LP column 42 which impacts the purity of the low pressure nitrogen product, line 46.

It is the relative difference between the flow from HP column 30 and the flow to LP column 42 which refrigeration, from hold-up tank 60 to distillation stem 24.

Ramp-up

Continuing with FIG. 2, ramp up in the ASU entails an increase in the feed air pressure, line 20, to the HP column 30. Consequently, HP column 30 and LP column 42 pressures must increase at a similar rate.

To increase the LP column 42 pressure, the low pressure nitrogen product flow, line 46, during the ramp up, is decreased by an amount that is more than proportional to the feed air flow. However, this adjustment alone would result in increased condensation and a decrease in gaseous oxygen product purity. As with ramp down, pressure and refrigeration needs are controlled together. To compensate for the effects of increased pressure, refrigeration in the distillation system is decreased by decreasing the impure nitrogen reflux, line 44, and thereby meeting the gaseous oxygen product demand, line 48, while maintaining its gaseous oxygen product purity.

With particular reference to the equations, the desired flow rate of gaseous oxygen product, line 48, is determined by IGCC demand, in this case an increase. This increased demand is used by ramp control 100 to calculate the feed forward setpoint of feed air, line 20. This setpoint is added, via setpoint adder 104, to the feedback purity measurement 152 of gaseous oxygen product, line 48, to calculate the flow setpoint for flow controller 26. Related to the feed air flow is the calculation of the LP column 42 pressure control. The change in the LP column 42 pressure is directly related to the change in the feed air pressure (see Eq. 1). Because the feed air flow, line 20, is increased, the pressure in the LP column 42 will increase. The feed forward setpoint which is calculated using Eq. 1 by ramp control 100 is added via setpoint adder 102 to the output of a controller which monitors the feed air valve 22 position to minimize the pressure drop across the feed air valve 22 and prevent its saturation. The output of adder 102 adjusts the pressure setpoint for pressure controller 74.

Having determined both the feed air flow, line 20, and the LP column pressure control, the next parameter to be maintained is the purity of the low pressure nitrogen product. This is controlled by the impure nitrogen reflux flow. First, flow of impure nitrogen reflux from the HP column 30 is directly related to the measured flow of feed air (see Eq. 2). Because the feed air flow, line 20, is increasing the flow of impure nitrogen reflux, line 44, from the HP column 30 will increase. The feed forward setpoint calculated using Eq. 2 by ramp control 100 is added via setpoint adder 110 to a nitrogen waste recycle flow measurement 56 and an impure nitrogen reflux purity measurement 112 to calculate the new impure nitrogen reflux flow from HP column 30 regulated by valve 52.

Second, the flow of the impure nitrogen reflux, line 44, into the LP column 42 is calculated using the ratio of impure nitrogen reflux, line 44, to low pressure nitrogen product, line 46 (see Eq. 3). Because the flow of low pressure nitrogen product, line 46, has decreased more than that proportional to the feed air flow for pressure control to maintain a constant ratio between impure nitrogen reflux flow, line 44, and low pressure nitrogen product flow, line 46, the impure nitrogen reflux, line 44, will decrease. Also, because the demand for gaseous oxygen product, line 48, is increasing the level in the hold-up tank 60 will increase (see Eq. 4), this level measurement 124 is used as a correction for Eq. 3. These calculations are used to determine the new setpoint for valve 54 for controlling the impure nitrogen reflux flow, line 44, to the LP column 42. The reflux is particularly critical in controlling the liquid to vapor (L/V) ratio in the LP column 42 which also impacts the purity of the gaseous oxygen product, line 48.

Once again, it is the relative difference between the flow from HP column 30 and the flow to LP column 42 which effects a net transfer of liquid nitrogen, or refrigeration, from distillation system 24 to hold-up tank 60.

One embodiment of ASU 10 as shown in FIG. 2 may have the following constants for the applicable equations and the following tuning parameters for the pressure/flow/level controllers:

| Constants | | | |
|---|---|---|---|
| Setpoint | Variable | Value | Units |
| Air Flow | $K_{Air}$ | 4.902 | lbmol/*lbmol* |
| | $K_{Air}^{Lag}$ | 1.75 | $min^{-1}$ |
| Pure $N_2$ Flow | $K_{N2}$ | | lbmol/*lbmol* |
| Recycle $N_2$ Flow | $K_{ReN2/Air}$ | 0.05 | lbmol/*lbmol* |
| | $K_{ReN2/FO2}$ | 3.703 | lbmol/*lbmol* |
| LP Column Pressure | $K_{LP}$ | 0.486 | psia/*lbmol* |
| Impure Reflux | $K_{Impure\ Reflux}$ | 0.321 | lbmol/*lbmol* |
| LIN Tank Level | $K_{Level}$ | 1.12[1] | ft/*lbmol* |

[1]For a LIN tank area of 70.0 $ft^2$

| Tuning Parameters | | |
|---|---|---|
| Control Loop | Gain | Reset |
| Air Flow | 0.005 | 0.5 $min^{-1}$ |
| LP Column Pressure | $-0.15 \frac{lbmol}{min}$ /psi | 1.5 $min^{-1}$ |
| Impure Reflux Flow - ex HP Column | 0.015 | 1.0 $min^{-1}$ |
| Impure Reflux Flow - ex LIN tank | 4.0 | 1.5 $min^{-1}$ |
| Expander Flow Control | 2.0 | 1.5 $min^{-1}$ |
| $O_2$ Purity Cascade | $4000 \frac{lbmol}{min}$ /fraction.02 | 30.0 $min^{-1}$ |
| Impure $N_2$ Purity | $-1000 \frac{lbmol}{min}$ /fraction.02 | 15.0 $min^{-1}$ |
| Impure Reflux Purity | $1000 \frac{lbmol}{min}$ /fraction.02 | 5.0 $min^{-1}$ |
| LIN Tank Level | $-0.02 \frac{lbmol}{min}$ /ft | 60.0 $min^{-1}$ |
| HP Sump Level | $-0.2 \frac{lbmol}{min}$ /ft | 1.0 $min^{-1}$ |
| Air Feed Valve Opening Loop | 10.0 psi/Fraction.Open | 5.0 $min^{-1}$ |

In the above description, nitrogen-rich fluid is withdrawn from a location a few trays below the top of HP column 30. Alternatively, this fluid can be withdrawn from any suitable location of this column. In general, the nitrogen content of this nitrogen-rich fluid should be greater than 90% nitrogen.

The present invention has been described with reference to a specific embodiment. This embodiment should not be seen as a limitation on the scope of the present invention; the scope of which is ascertained by the following claims.

What is claimed:

1. In a process for the separation of feed air in a cryogenic distillation system having at least one distillation column wherein feed air is separated into at least oxygen-rich and nitrogen-rich products, the improvement for substantially maintaining purity requirements during variations in product demand and feed air pressure comprising the steps of:

a) removing and storing refrigeration in the form of nitrogen-rich fluid from the distillation system as the feed air pressure substantially increases; and b) adding refrigeration in the form of nitrogen-rich fluid to the distillation system from the stored nitrogen-rich fluid as the feed air pressure substantially decreases.

2. The process of claim 1, in which steps a) and b) further include the step of providing for removing, storing, and adding refrigeration by way of a reflux flow of nitrogen-rich fluid in the distillation system.

3. The process of claim 2, in which the step of storing refrigeration further includes storing the refrigeration in a storage vessel, and there is provided the further steps of controlling the reflux flow upstream and controlling the reflux flow downstream of the storage vessel.

4. The process of claim 1, in which the step of storing refrigeration further includes storing the refrigeration in a storage vessel.

5. The process of claim 1, wherein said distillation system is a double column system including a high pressure distillation column, a low pressure distillation column, and a reflux path flowing from the high pressure column to the low pressure column.

6. The process of claim 5, in which step a) further includes the step of decreasing the flow of nitrogen-rich product from the low pressure distillation column proportional to feed air flow as the feed air pressure increases.

7. The process of claim 5, in which step b) further includes the step of increasing the flow of nitrogen-rich product from the low pressure distillation column proportional to feed air flow as the feed air pressure decreases.

8. The process of claim 1, wherein said nitrogen-rich fluid is at least 90% nitrogen.

9. In a process for the separation of air in a cryogenic distillation system having at least one distillation column where air is separated into at least oxygen-rich and nitrogen-rich products, the improvement for substantially maintaining purity requirements upon (1) increase in product demand and increase in feed air pressure and (2) decrease in product demand and decrease in feed air pressure comprising the steps of:

(a) providing a reflux flow of nitrogen-rich fluid in the distillation system;

(b) removing and storing a portion of the nitrogen-rich reflux flow fluid as the product demand increases and the feed air pressure substantially increases, and (c) adding to the reflux flow a portion of the stored nitrogen-rich fluid as the product demand decreases and the feed air pressure substantially decreases.

10. The process of claim 9, wherein said distillation system is a double column system including a high pressure distillation column, a low pressure distillation column, and a reflux path flowing from the high pressure column to the low pressure column.

11. The process of claim 10, in which step (b) further includes the step of decreasing the flow of nitrogen-rich product from the low pressure distillation column proportional to feed air flow as the feed air pressure increases.

12. The process of claim 10, in which step (c) further includes the step of increasing the flow of nitrogen-rich product from the low pressure distillation column proportional to feed air flow as the feed air pressure decreases.

13. The process of claim 9, wherein said distillation system is a double column system including a high pressure distillation column and a low pressure distillation column, in which there is provided the further step of recycling a portion of the nitrogen-rich product from the low pressure distillation column to the high pressure distillation column.

14. The process of claim 13, in which there is provided the further step of controlling the recycling of the portion of nitrogen-rich product for maintaining the purity of the nitrogen-rich product from the low pressure distillation column.

15. A cryogenic distillation system having at least one distillation column for separating air into at least oxygen-rich and nitrogen-rich products for an integrated gasifier combined cycle power plant (IGCC) in which purity requirements are maintained during variations in product demand by the IGCC and during variations of feed air pressure comprising:

reflux flow means for said distillation system for providing reflux flow of nitrogen-rich fluid;

storage means coupled to said reflux flow means for storing nitrogen-rich fluid; and means for controlling the reflux flow (1) for removing nitrogen-rich fluid from the reflux flow means and storing said removed nitrogen-rich fluid in said storage means as the product demand and the feed air pressure substantially increases and (2) for adding nitrogen-rich fluid from the storage means to the reflux flow means as the product demand and the feed air pressure substantially decreases.

16. The system of claim 15, in which said storage means comprises a storage vessel and which further comprises means for controlling the reflux flow upstream and downstream of the storage vessel.

17. In a process for the separation of air in a double column cryogenic distillation system having a low pressure column, a high pressure column, and reflux flows from the high pressure column to the low pressure column wherein air is separated into at least oxygen-rich and nitrogen-rich products, the improvement for substantially maintaining purity requirements during variations in product demand and feed air pressure comprising the steps of:

(a) upon an increase in oxygen product demand, increasing feed air pressure and decreasing flow of nitrogen-rich product from the low pressure column, thereby increasing the pressure in the low pressure column;

(b) upon a decrease in oxygen product demand, decreasing feed air pressure and increasing flow of nitrogen-rich product from the low pressure column, thereby decreasing the pressure in the low pressure column;

(c) removing and storing a portion of the nitrogen-rich reflux flow fluid as the product demand increases and the feed air pressure substantially increases; and (d) adding to the reflux flow a portion of the stored nitrogen-rich fluid as the product demand decreases and the feed air pressure substantially decreases.

18. The process of claim 17, in which there is provided the further step of measuring the purity of the oxygen-rich product from the low pressure column and controlling the feed air pressure as a function of the oxygen product purity measurement.

19. The process of claim 17, in which there is provided the further step of measuring the purity of the nitrogen-rich product from the low pressure column and controlling a portion of the nitrogen-rich product from the low pressure column as a function of the purity measurement.

20. The process of claim 17, in which there is provided the further step of measuring the purity of the reflux flow and controlling the reflux flow as a function of the purity measurement.

21. The process of claim 1 wherein step a) includes removing and storing refrigeration in the form of nitrogen-rich liquid from the distillation system as the feed air pressure increases by at least 3% per minute.

22. The process of claim 21 wherein step b) includes adding refrigeration in the form of nitrogen-rich liquid to the distillation system as the feed air pressure decreases by at least 3% per minute.

* * * * *